US008000629B2

(12) United States Patent
Tamura

(10) Patent No.: US 8,000,629 B2
(45) Date of Patent: Aug. 16, 2011

(54) PROCESS CARTRIDGE HAVING CHARGER AND IMAGE FORMING DEVICE PROVIDED WITH THE PROCESS CARTRIDGE

(75) Inventor: Aya Tamura, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 129 days.

(21) Appl. No.: 12/603,418

(22) Filed: Oct. 21, 2009

(65) Prior Publication Data

US 2010/0129111 A1 May 27, 2010

(30) Foreign Application Priority Data

Nov. 26, 2008 (JP) ..... 2008-300610

(51) Int. Cl.
*G03G 21/18* (2006.01)

(52) U.S. Cl. ..... 399/111; 399/92; 399/107

(58) Field of Classification Search ..... 399/92, 399/100, 107, 111, 115, 343
See application file for complete search history.

(56) References Cited

U.S. PATENT DOCUMENTS

| | | | | |
|---|---|---|---|---|
| 5,808,649 | A | 9/1998 | Shimanari | |
| 2006/0034635 | A1 | 2/2006 | Itabashi | |
| 2007/0036581 | A1 | 2/2007 | Okabe | |
| 2008/0101816 | A1* | 5/2008 | Nogami | 399/92 |

FOREIGN PATENT DOCUMENTS

| | | | |
|---|---|---|---|
| JP | H05-323755 | A | 12/1993 |
| JP | H09-160333 | A | 6/1997 |
| JP | H09-204090 | A | 8/1997 |
| JP | 2000-258968 | A | 9/2000 |
| JP | 2001-117472 | A | 4/2001 |
| JP | 2003-084632 | A | 3/2003 |
| JP | 2006-053233 | A | 2/2006 |
| JP | 2006-091327 | A | 4/2006 |
| JP | 2006-184751 | A | 7/2006 |
| JP | 2007-072421 | A | 3/2007 |
| JP | 2008-268527 | A | 11/2008 |
| JP | 2008-268528 | A | 11/2008 |

OTHER PUBLICATIONS

Japan Patent Office; Office Action in Japanese Patent Application No. 2008-300610 (counterpart to the above-captioned US Patent Application) mailed on Sep. 14, 2010.

Japan Patent Office, Office Action for Japanese Patent Application No. 2008-300610 (counterpart to above-captioned patent application), mailed Feb. 22, 2011.

* cited by examiner

*Primary Examiner* — David P Porta
*Assistant Examiner* — Mark R Gaworecki
(74) *Attorney, Agent, or Firm* — Baker Botts L.L.P.

(57) ABSTRACT

An image forming device includes a process cartridge, a wall section, and a flow restrictor. The process cartridge includes a photosensitive drum, a charger, and a frame. The charger is disposed spaced away from the photosensitive drum for charging the photosensitive drum. The frame is formed with a first opening at a position opposite to the photosensitive drum with respect to the charger. The frame is also formed with a first vent hole for ventilation of a space defined by the frame. The first vent hole is positioned upstream of the first opening and downstream of the image transfer position of the photosensitive drum in the rotational direction of the photosensitive drum. The wall section is positioned in direct confrontation with the first opening. The flow restrictor restricts air flow and is provided between the frame and the wall section.

26 Claims, 12 Drawing Sheets

PROCESS CARTRIDGE HAVING CHARGER AND IMAGE FORMING DEVICE PROVIDED WITH THE PROCESS CARTRIDGE

CROSS REFERENCE TO RELATED APPLICATION

This application claims priority from Japanese Patent Application No. 2008-300610 filed Nov. 26, 2008. The entire content of this priority application is incorporated herein by reference.

TECHNICAL FIELD

The present invention relates to an image-forming device provided with a process cartridge having a charger. The invention also relates to the process cartridge detachably mounted in the image forming device.

BACKGROUND

In an electrophotographic type image forming device, a laser beam is irradiated to a charged photosensitive drum to form an electrostatic latent image thereon, and a toner image formed by supplying toner to the electrostatic latent image is transferred on a sheet.

The image forming device includes a process cartridge having a charger and a frame. The charger includes a corona discharge type wire adapted for charging the photosensitive drum. The frame is formed with an opening located at a position opposed to the photosensitive drum with respect to the charger. An ion is generated on the wire by applying a voltage thereto, and ion wind moves toward and impinges on the photosensitive drum, whereupon the photosensitive drum is electrically charged with a polarity.

SUMMARY

However, for charging the photosensitive drum, the ion wind generated in the charger should be controlled. If the ion wind is impinged on a contaminated area of the photosensitive drum, the ion wind may be contaminated with dust or foreign materials, and such contaminated ion flow may return to the charger. As a result, dust or foreign materials may be deposited on the wire, leading to degradation of the charging efficiency of the charger.

In view of the foregoing, it is an object of the present invention to provide an image forming device and process cartridge capable of restricting the deposition of the dust and foreign materials on the charger and maintaining the efficiency of the charger.

In order to attain the above and other objects, the invention provides an image forming device including a process cartridge, a wall section, and a flow restrictor. The process cartridge includes a photosensitive drum, a charger, and a frame. The photosensitive drum is rotatable about an axis in a rotational direction and defines an image transfer position where a toner is transferred to an electrostatic latent image area formed on the photosensitive drum. The charger is disposed spaced away from the photosensitive drum for charging the photosensitive drum. The frame is formed with a first opening at a position opposite to the photosensitive drum with respect to the charger. The frame is also formed with a first vent hole for ventilation of a space defined by the frame. The first vent hole is positioned upstream of the first opening and downstream of the image transfer position of the photosensitive drum in the rotational direction of the photosensitive drum.

The wall section is positioned in direct confrontation with the first opening. The flow restrictor restricts air flow and provided between the frame and the wall section and between the first opening and the first vent hole.

According to another aspect, the present invention provides a process cartridge installed on an install portion of an image forming device. The install portion includes a wall section. The process cartridge includes a photosensitive drum, a charger, a frame, and a flow restrictor. The photosensitive drum is rotatable about an axis in a rotational direction and defines an image transfer position where a toner is transferred to an electrostatic latent image area formed on the photosensitive drum. The charger is disposed spaced away from the photosensitive drum for charging the photosensitive drum. The frame is formed with a first opening at a position opposite to the photosensitive drum with respect to the charger. The first opening is in direct confrontation with the wall section upon installation of the frame into the install portion. The frame is also formed with a first vent hole for ventilation of a space defined by the frame. The first vent hole is positioned upstream of the first opening and downstream of the image transfer position of the photosensitive drum in the rotational direction of the photosensitive drum. The flow restrictor restricts air flow and provided between the frame and the wall section and between the first opening and the first vent hole.

According to still another aspect, the present invention provides a process cartridge installed on an install portion of an image forming device in a juxtaposed fashion so that mutually neighboring process cartridges are positioned side by side. The process cartridge includes a photosensitive drum, a charger, a frame, and a flow restrictor. The photosensitive drum is rotatable about an axis in a rotational direction and defining an image transfer position where a toner is transferred to an electrostatic latent image area formed on the photosensitive drum. The charger is disposed spaced away from the photosensitive drum for charging the photosensitive drum. The frame is formed with a first opening at a position opposite to the photosensitive drum with respect to the charger. The first opening is in direct confrontation with a neighboring process cartridge upon installation of the frame into the install portion. The frame is also formed with a first vent hole for ventilation of a space defined by the frame. The first vent hole is positioned upstream of the first opening and downstream of the image transfer position of the photosensitive drum in the rotational direction of the photosensitive drum. The flow restrictor restricts air flow flowing between the frame and the neighboring process cartridge. The flow restrictor is positioned between the first opening and the first vent hole.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, an image forming device according to a first embodiment of the present invention will be described while referring to FIGS. 1 through 5. The terms "upward", "downward", "upper", "lower", "above", "below", "right", "left", "front", "rear" and the like will be used throughout the description assuming that the image forming device is disposed in an orientation in which it is intended to be used.

Figure 1:
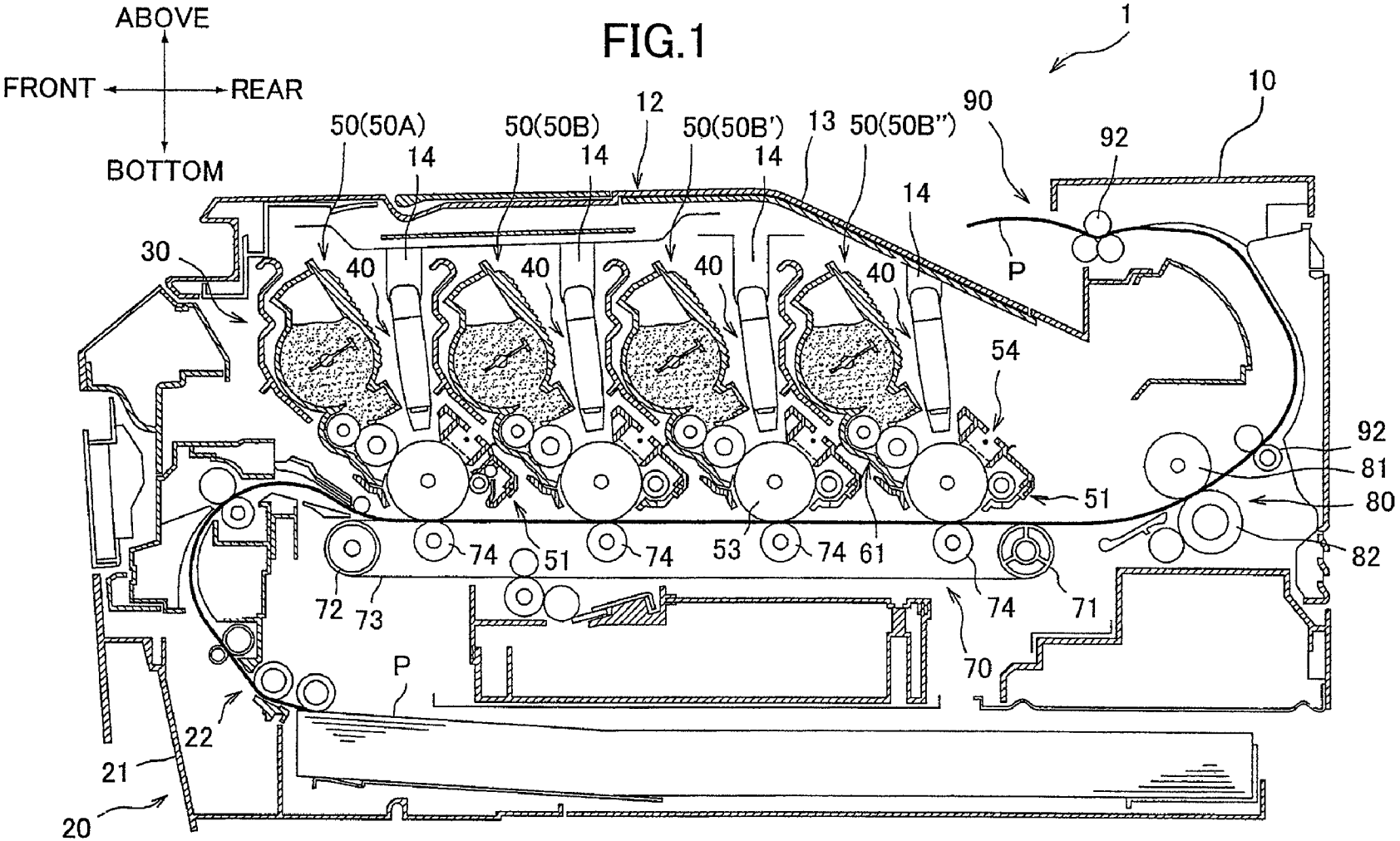
FIG. 1 is a cross-sectional view of an entire configuration of a color printer according to a first embodiment of the present invention.

As shown in FIG. 1, the image forming device 1 includes a main frame 10. In the main frame 10, a sheet feeding unit 20 for supplying a sheet P, an image forming unit 30 for forming an image on the supplied sheet P, and a discharge unit 90 for discharging the sheet P bearing an image are provided.

The main frame 10 has an upper position at which an upper cover 12 can be opened and closed. The upper cover 12 is pivotally movable in an upper/lower direction about a hinge (not shown) provided rearward thereof. The upper cover 12 has an upper surface functioning as a sheet tray 13, and the upper cover 12 has a lower surface provided with a plurality of support frames 14 each supporting an upper part of an LED (Light Emitting Diode) array 40 described later.

The sheet feeding unit 20 is provided at a lower position of the main frame 10. The sheet feeding unit 20 includes a sheet tray 21 that is detachably mounted in the main frame 10 and a sheet supplying mechanism 22 for transmitting the sheet P from the sheet tray 21 to the image forming unit 30.

The image forming unit 30 includes four LED arrays 40, four process cartridges 50, a transfer unit 70, and a fixing unit 80. The LED array 40 includes a plurality of LEDs arrayed in line in a lateral direction (widthwise direction of the sheet P).

Each of the LEDs in the LED array 40 is selectively turning on and off according to an image data. The LED array 40 has a light emitting end in confrontation with the photosensitive drum 53 and another end opposite to the light emitting end. The main frame 14 supports the other end of the LED array 40.

The process cartridges 50 are juxtaposed in front-to-rear direction between the upper cover 12 and the sheet feeding unit 20. The process cartridges 50 respectively accommodate four toner colors black, cyan, magenta, and yellow. The process cartridges 50 are detachably mounted in the main frame 10 and are accessible through an upper opening upon opening the upper cover 12.

The configuration of a most upstream side process cartridge 50A is different from that of a remaining three process cartridges 50B, 50B', and 50B". The general configuration of the process cartridge 50 will be described below with reference to the most upstream side process cartridge 50A and the detailed configuration thereof will be described later.

Figure 2:
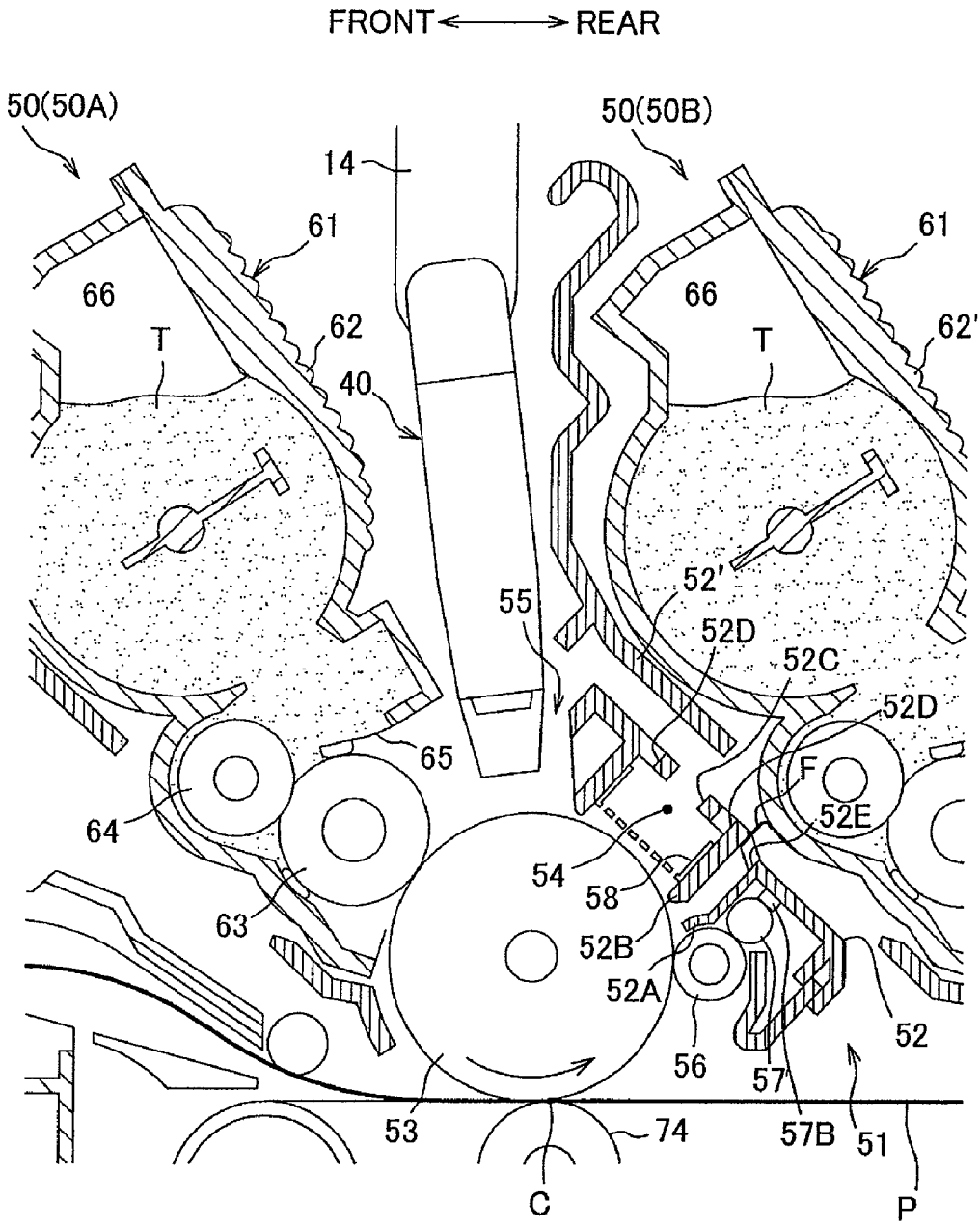
FIG. 2 is an enlarged cross-sectional view showing a most upstream process cartridge according to the first embodiment.

The process cartridge 50 includes a drum unit 51 and a developer cartridge 61 detachably mounted in the drum unit 51 as shown in FIG. 2. The drum unit 51 includes a drum frame 52, a photosensitive drum 53 rotatable in a counterclockwise direction in FIG. 2, a charging wire 54 and a grid 58 which are separated from the photosensitive drum 53. The drum frame 52 is formed with an opening 55 for exposing the photosensitive drum 53 outwardly upon mounting the developer cartridge 61. The photosensitive drum 53 is exposed to light emitted from the LED array 40 based on the image data, thereby forming an electrostatic latent image thereon. The electrostatic latent image is developed into a toner image and the toner image is transferred to the sheet P at the transfer position C.

The opening 55 is formed at a position downstream of the charging wire 54 and upstream of the transfer position C in the rotating direction of the photosensitive drum 53. The LED array 40 is inserted into the opening 55.

The developer cartridge 61 includes a developing frame 62, a developing roller 63 and a toner supply roller 64 which are rotatably supported by the developing frame 62, a thickness-regulating blade 65 in sliding contact with the developing roller 63, and a toner housing 66 for accommodating toner T therein.

As shown in FIG. 1, the transfer unit 70 includes a drive roller 71, a follower roller 72, an endless transfer belt 73, and a transfer rollers 74. The drive roller 71 and the follower roller 72 are separated in a front-to-rear direction and extend in parallel with each other. The endless transfer belt 73 is mounted under tension between the drive roller 71 and the follower roller 72. The endless transfer belt 73 has an outer side surface in contact with the photosensitive drum 53 at the transfer position C. The four transfer rollers 74 are disposed at an inner side of the transfer belt 73 to nip the transfer belt 73 in cooperation with the photosensitive drum 53. A transfer bias is applied to the transfer roller 74 in a constant current control when transferring.

The fixing unit 80 includes a heat roller 81 and a pressure roller 82 disposed opposite to the heat roller 81 and pressing the heat roller 81.

In the image forming unit 30, the surface of the photosensitive drum 53 is uniformly charged by the charging wire 54 with positive polarity, and then is exposed to light emitted from the LED array 40. As a result, the potential of the exposed portion is decreased to form the electrostatic latent image based on the image data on each photosensitive drum 53.

A corona discharge is generated between the charging wire 54 and the photosensitive drum 53 by applying the voltage to the charging wire 54 while charging the photosensitive drum 53. The charging wire 54 generates an ion during the generation of the corona discharge. A potential difference between the charging wire 54 and the surface of the photosensitive drum 53 causes the ion to move toward the surface of the photosensitive drum 53. The ion moves from the charging wire 54 to the surface of the photosensitive drum 53 so that an ion wind toward the photosensitive drum 53 is generated.

The toner supply roller 64 is adapted to supply the toner T accommodated in the toner housing 66 to the developing roller 63. As the developing roller 63 continues to rotate, the toner T supplied onto the surface of the developing roller 63 passes between the developing roller 63 and the thickness-regulating blade 65, at which time the toner is smoothed so that a thin layer of uniform thickness is carried on the developing roller 63. The toner T carried on the developing roller 63 is positively charged by the friction generated between the toner supply roller 64 and the developing roller 63 or the developing roller 63 and the thickness-regulating blade 65.

The toner T carried on the developing roller 63 is supplied to the electrostatic latent image formed on the photosensitive drum 53. In this way, the toner T is selectively carried on the photosensitive drum 53, developing the electrostatic latent image into a visible toner image, and forming the toner image (inversed image) thereon.

By passing through the sheet P supplied on the endless transfer belt 73 between the each photosensitive drum 53 and the transfer roller 74, the toner images formed on each photosensitive drum 53 are superimposed on the sheet P. When the sheet P passes between the heat roller 81 and the pressure roller 82, the toner image is thermally fixed on the sheet P.

The discharge unit 90 includes a plurality of discharge roller 92. The sheet P forming the toner image thereon is discharged by the discharge roller 92 onto the sheet discharge tray 13.

Next, a detailed configuration of the process cartridges 50A, 50B will be described below with reference to the FIGS. 2 through 4. As shown in FIG. 2, the most upstream side process cartridge 50A further includes a cleaning roller 56, a collection roller 57, a remover 57B, and the grid 58. The cleaning roller 56 is adapted to absorb the toner T and foreign materials on the photosensitive drum 53 and is disposed at a position contacting the photosensitive drum 53. The foreign materials include a paper dust and other dust. Specifically, the cleaning roller 56 is disposed at a position upstream of the charging wire 54 and downstream of the transfer position C in the rotating direction of the photosensitive drum 53.

The collection roller 57 is adapted to absorb the foreign materials and the toner on the cleaning roller 56 and disposed at a position contacting the cleaning roller 56. The remover 57B formed of a sponge is provided in contact with the collection roller 57 for removing the foreign materials absorbed by the collection roller 57.

The grid 58 is adapted to commutate a potential of the ion moving from the charging wire 54 to the surface of the photosensitive drum 53. The grid 58 has a box shape with the upper side open and has a bottom wall in which a plurality of holes are formed.

The drum frame 52 includes a partitioning wall 52A and a pair of support walls 52B. The partitioning wall 52A is adapted to separate a space ambient to the charging wire 54 from a space ambient to the cleaning roller 56 and collection roller 57. The pair of support walls 52B are adapted for supporting side walls of the grid 58.

The drum frame 52 is formed with a charging opening 52C at a position opposite to the photosensitive drum 53 with respect to the charging wire 54. Specifically, the charging opening 52C is formed between the pair of support walls 52B. The process cartridge 50B neighboring the most upstream side process cartridge 50A has a drum frame 52' disposed in confrontation with the charging opening 52C of the most upstream side process cartridge 50A.

Figure 3:
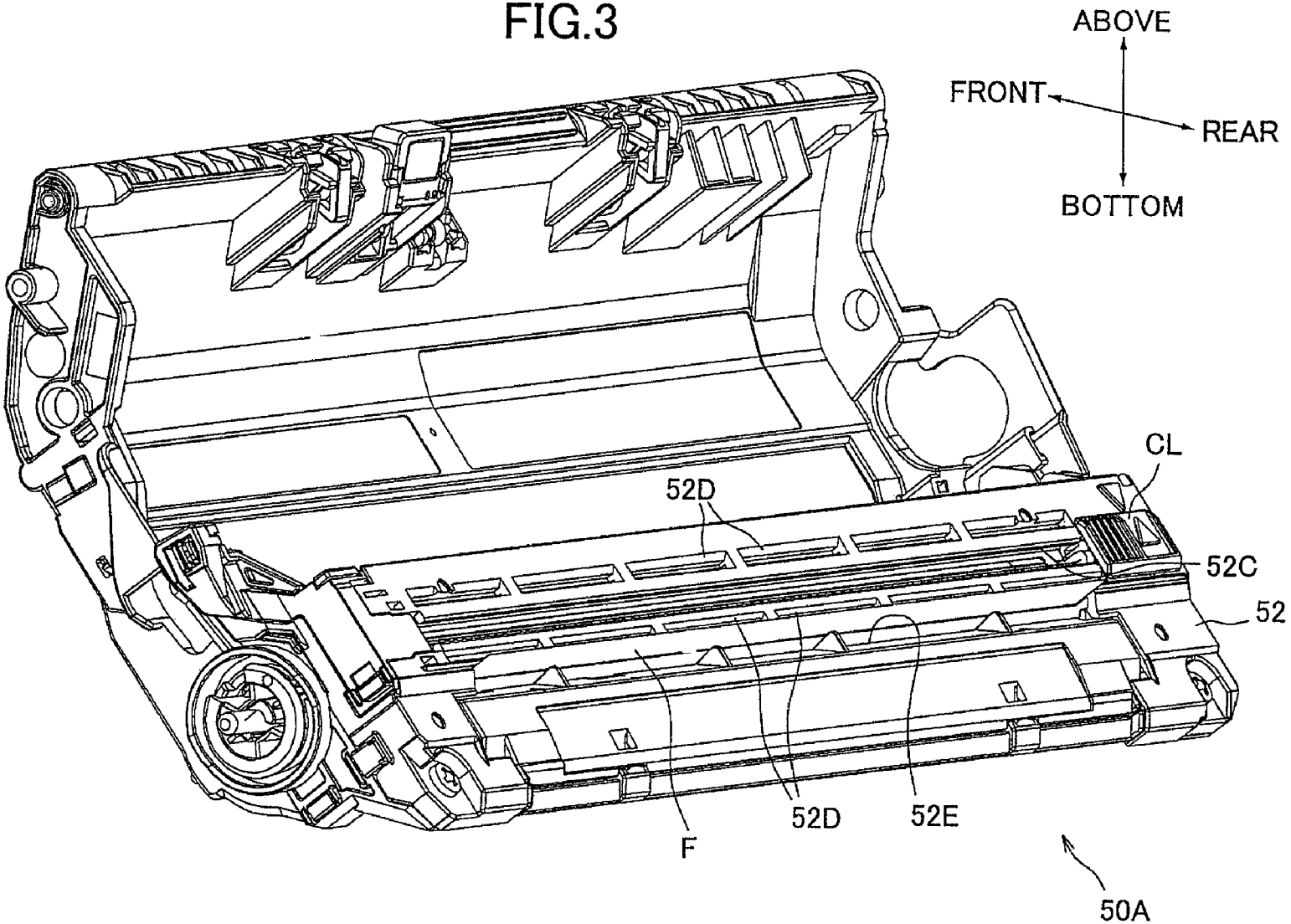
FIG. 3 is a perspective view showing the most upstream process cartridge according to the first embodiment.
Figure 4:
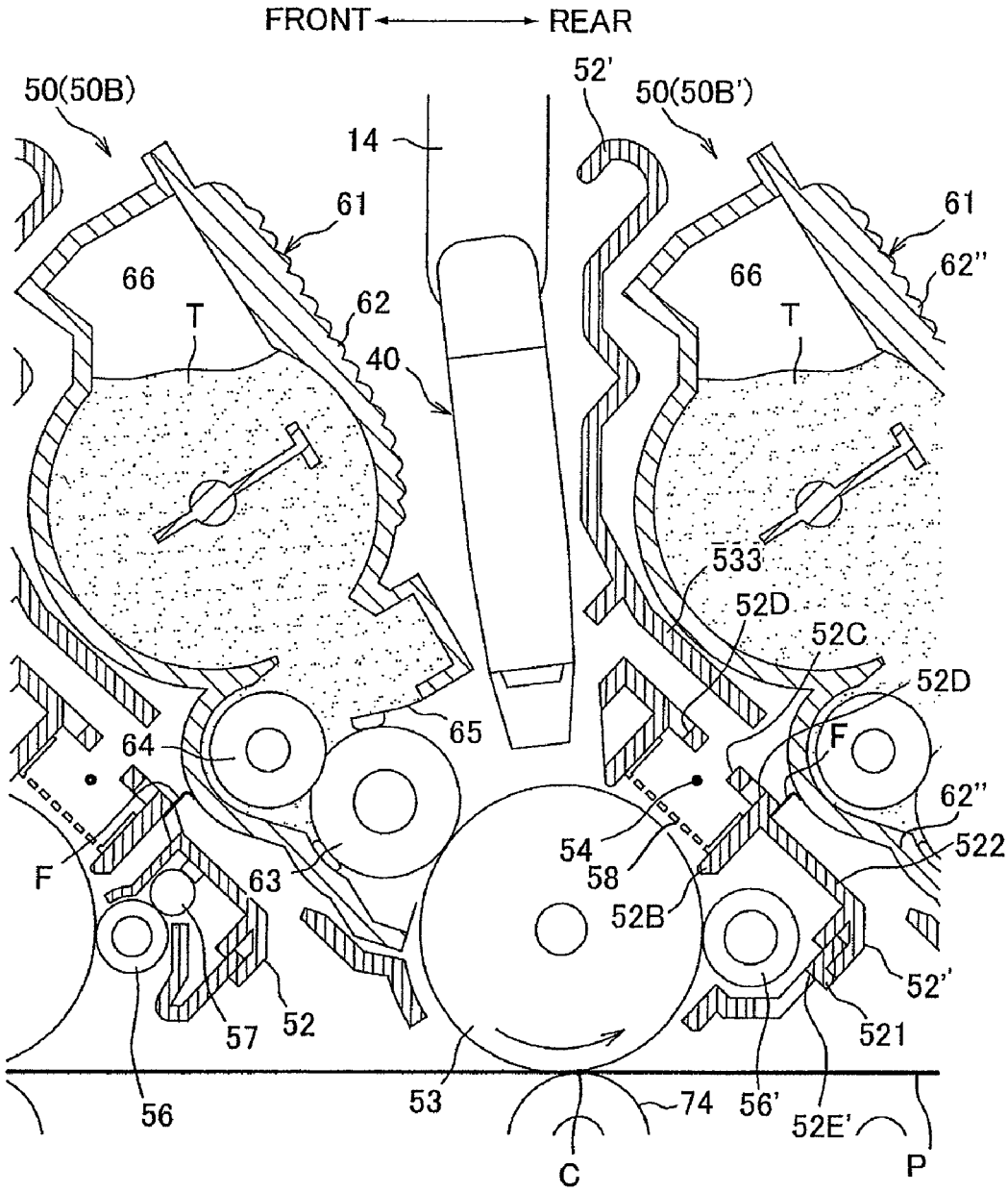
FIG. 4 is an enlarged cross-sectional view showing a process cartridge other than the most upstream process cartridge according to the first embodiment.

As shown in FIG. 3, the charging opening 52C is configured of a slit shape extending in a right-to-left direction. The charging opening 52C has a left side portion on which a cleaner CL is provided. The cleaner CL is movable in right-to-left direction while contacting the charging wire 54.

The drum frame 52 is formed with a plurality of second openings 52D formed on both sides of the charging opening 52C in order to introduce an air from outside of the drum frame 52 into a region ambient to the charging wire 54 and the grid 58 as shown in FIG. 2. The plurality of second openings 52D are arranged in right-to-left direction as shown in FIG. 3. With this configuration, ribs can be formed between the neighboring second openings 52D in comparison with a configuration where an elongated single second opening 52D extending in the lateral direction is formed like the charging opening 52C. Thus, the strength of a portion supporting the cleaner CL can be improved.

As shown in FIG. 2, the drum frame 52 is formed with a first opening 52E formed at a position upstream of the charging opening 52C and downstream of the transfer position C in the rotating direction of the photosensitive drum 53. The first opening 52E is adapted for ventilation of the drum frame 52. Specifically, the first opening 52E is formed between the support wall 52B and the partitioning wall 52A.

The first opening 52E is a through-hole with which a film F is provided. The film F having elasticity is disposed at a position between the frame 52 of the most upstream side process cartridge 50A and the neighboring frame 52' of the process cartridge 50B so as to regulate air flowing therebetween.

The film F protrudes upward and is fixed on the charging opening 52C side of the first opening 52E. The top edge of the film F contacts the developing frame 62' of the process cartridge 50B juxtaposed with the most upstream side process cartridge 50A.

The film F is formed of the elastic material. This configuration can prevent vibration occurring at the process cartridge 50A provided with the film F from being transmitted to the process cartridge 50B contacting the film F. Thus, degradation of the image quality can be avoided.

The configuration of the process cartridge 50B is the same as that of the most upstream side process cartridge 50A except that the process cartridge 50B does not have the collection roller 57 provided in the most upstream side process cartridge 50A. Since the foreign materials attached on the sheet P can be sufficiently collected by the collection roller upon passing through the most upstream side process cartridge 50A. Therefore, foreign materials may not be introduced into the process cartridge 50B, thereby avoiding necessity of providing the collection roller at the process cartridge 50B.

The process cartridge 50B includes a cleaning roller 56' similar to that of the most upstream side process cartridge 50A.

The drum frame 52' of the process cartridge 50B also includes an upper wall 522, a lower wall 533 and an end wall 521. The drum frame 52' is formed with a first opening 52E' disposed at a position different from the position of the first opening 52E of the most upstream side process cartridge 50A. That is, the first opening 52E' is positioned opposite to the photosensitive drum 53 with respect to the rotation center of the cleaning roller 56'.

The upper wall 522 is in confrontation with a developing frame 62" of the process cartridge 50B. The end wall 521 is elongated in a direction perpendicular to the upper wall 522. The first opening 52E' is formed on the end wall 521 of the process cartridge 50B. The first opening 52E' is preferably provided by a plurality of through-holes arranged in right-to-left direction to improve the strength of the drum frame 52'.

The first opening 52E' is formed on the end wall 521 so that the charging opening 52C, the second opening 52D, the grid 58, the support wall 52B, the upper wall 522, and the cleaning roller 56' form a path through which the air flows from the charging opening 52C to the first opening 52E'.

The elastic film F is provided between the drum frame 52' (upper wall 522) of the process cartridge 50B and the drum frame 52' (lower wall 533) of the process cartridge 50B' neighboring to the process cartridge 50B. The film F is fixed on a position in which the upper wall 522 is in contact with the support wall 52B and contacts the neighboring process cartridge 50B'.

The ion wind upon charging the photosensitive drum 53 by the charging wire 54 will be described while referring to the FIG. 5. An air in each process cartridge 50 is flowed by an electric fan (not shown) and the ion wind from the opening 55 side to the charging wire 54 side.

Figure 5:
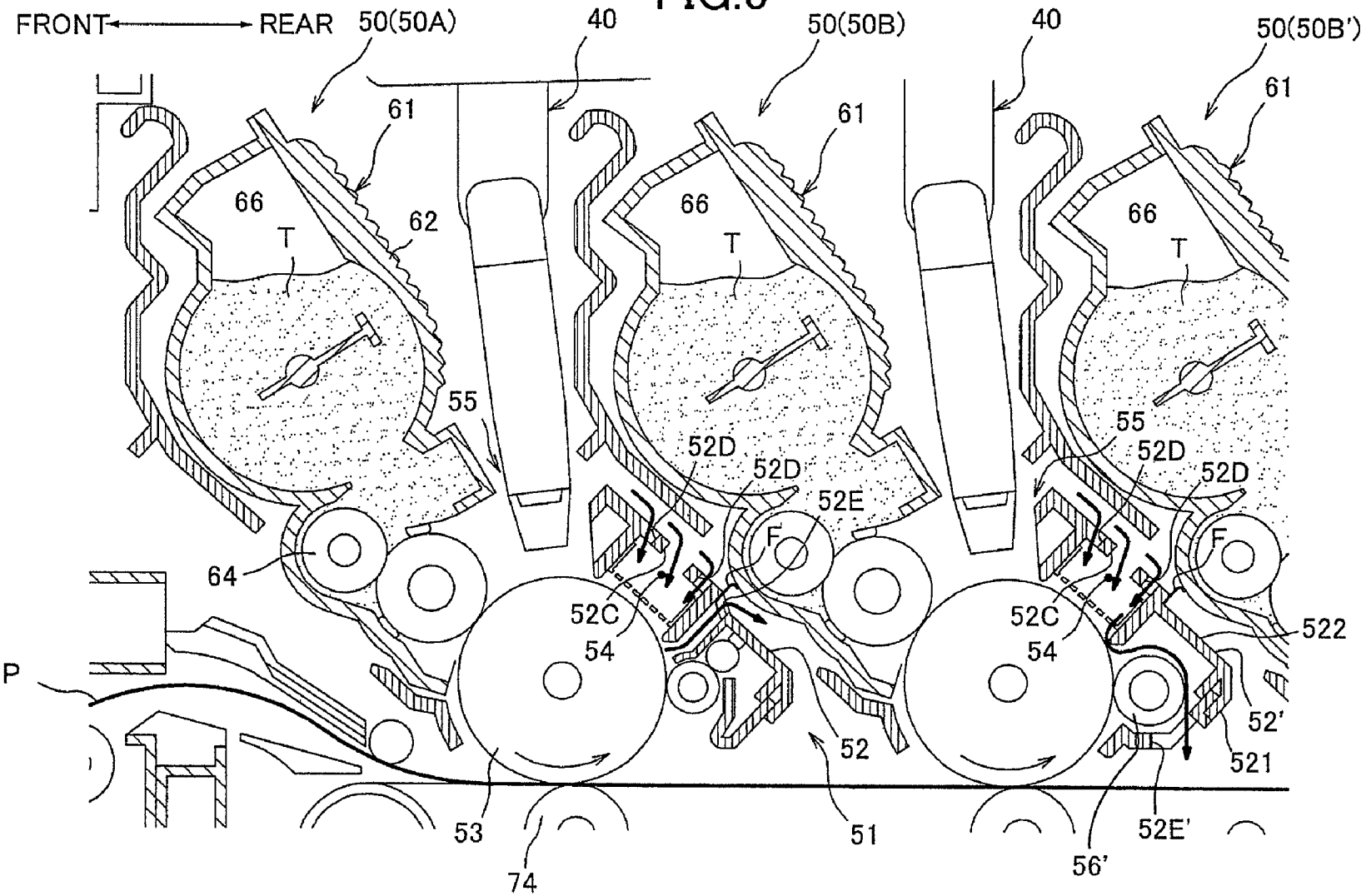
FIG. 5 is an enlarged view illustrating a flow of an ion wind in the first embodiment.

As shown in FIG. 5, when applying an electric bias to the charging wire 54, the air flowing from the opening 55 to the charging wire 54 is interrupted by the film F and introduced into the region ambient to the charging wire 54 through the charging opening 52C and the second opening 52D. The ion wind can flow from the charging wire 54 to the photosensitive drum 53, thereby sufficiently charging the photosensitive drum 53.

The ion wind impinged on the photosensitive drum 53 is discharged through the first opening 52E and 52E'. The film F prevents the ion wind from returning back to the charging opening 52C.

With this configuration, if the ion wind impinged on the photosensitive drum 53 is polluted by the toner T or foreign materials deposited on the photosensitive drum 53, the film F prevents the polluted ion wind from returning back to the charging opening 52C. Therefore, the charging wire 54 can maintain charging performance because deposition of the toner T or foreign materials onto the charging wire 54 can be prevented.

By forming the second opening 52D ambient to the charging opening 52C, a large amount of air can be introduced into the region ambient to the charging wire 54. This configuration can prompt the generation of ion wind, thereby charging the photosensitive drum 53 sufficiently.

The first opening 52E is formed between the charging opening 52C and the partitioning wall 52A in the most upstream side process cartridge 50A. With this configuration, the ion wind cannot blow up the foreign materials and paper dust collected on the collection roller 57, thereby improving the quality of the image formed on the sheet P.

Since the first opening 52E' formed on the process cartridge 50B is positioned opposite to the photosensitive drum 53 with respect to the cleaning roller 56', the ion wind can flow smoothly rather than the configuration where the ion wind flows along U shape path in case of the most upstream side process cartridge 50A. The collection roller 57 in the most upstream side process cartridge 50A has already collected the paper dust or foreign materials. Thus, the cleaning roller 56' in the process cartridge 50B catches only the toner T by the electrical force or the intermolecular force (van de Waals force). Thus, the ion wind cannot blow up the toner T on the cleaning roller 56'.

The LED array 40 is disposed at a position downstream of the charging opening 52C in the rotating direction of the photosensitive drum 53, i.e., upstream side of the ion wind flow generated around the charging wire 54. Thus, an end face of the LED array 40 can be protected against the toner T and foreign materials carried by the ion wind.

The first opening 52E' of the process cartridge 50B is formed not on the upper wall 522 facing to the process cartridge 50B' but on the end wall 521. Thus, returning the ion wind to the charging opening 52C can be avoided since the ion wind discharged through the first opening 52E' does not go through a path between the process cartridge 50B' and the upper wall 522.

Figure 6:
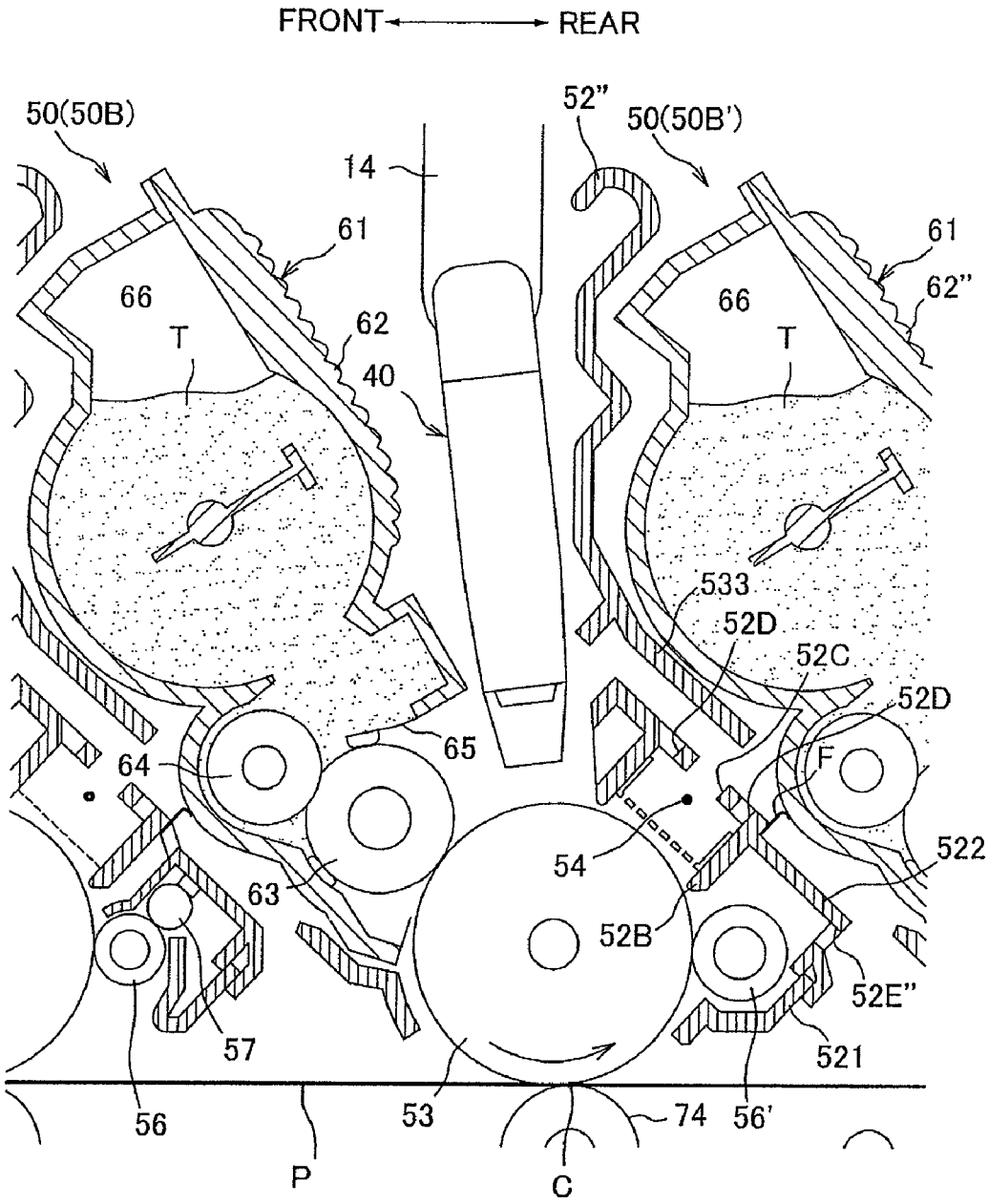
FIG. 6 is an enlarged cross sectional view showing a process cartridge other than a most upstream process cartridge according to a second embodiment of the present invention.
Figure 7:
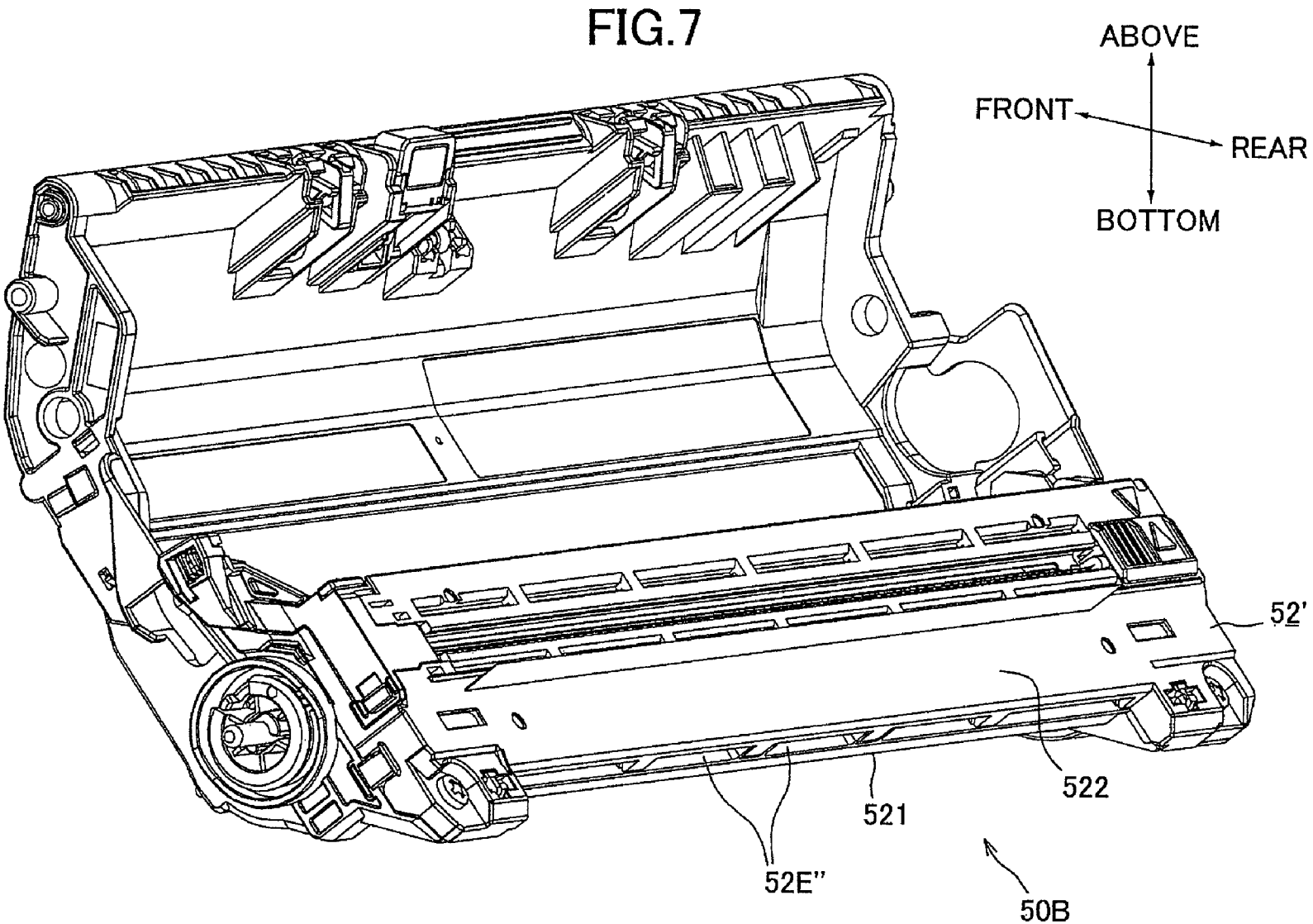
FIG. 7 is a perspective view of the process cartridge according to the second embodiment.

Next, a process cartridge according to a second embodiment of the present invention will be described below with reference to FIGS. 6 and 7, wherein like parts and components are designated by the same reference numbers as those shown in FIGS. 1-5.

In the second embodiment, the drum frame 52 is formed with a first opening 52E" positioned neighboring to the upper wall 522. The first opening 52E" is positioned at the charging wire 54 side rather than the cleaning roller 56' side in a direction leading from a center of the photosensitive drum 53 to the charging wire 54. In other words, the first opening 52E" is positioned farther from the photosensitive drum 53 than the cleaning member 56' from the photosensitive drum 53 and is exceeding over the charging wire 54 as viewed from the photosensitive drum 53 in an opposing direction between the photosensitive drum 53 and the charging wire 54. With this configuration, the ion wind can linearly flow smoothly since the ion wind flows linearly after passing through the support wall 52B and is subsequently discharged via the first opening 52E".

Figure 8:
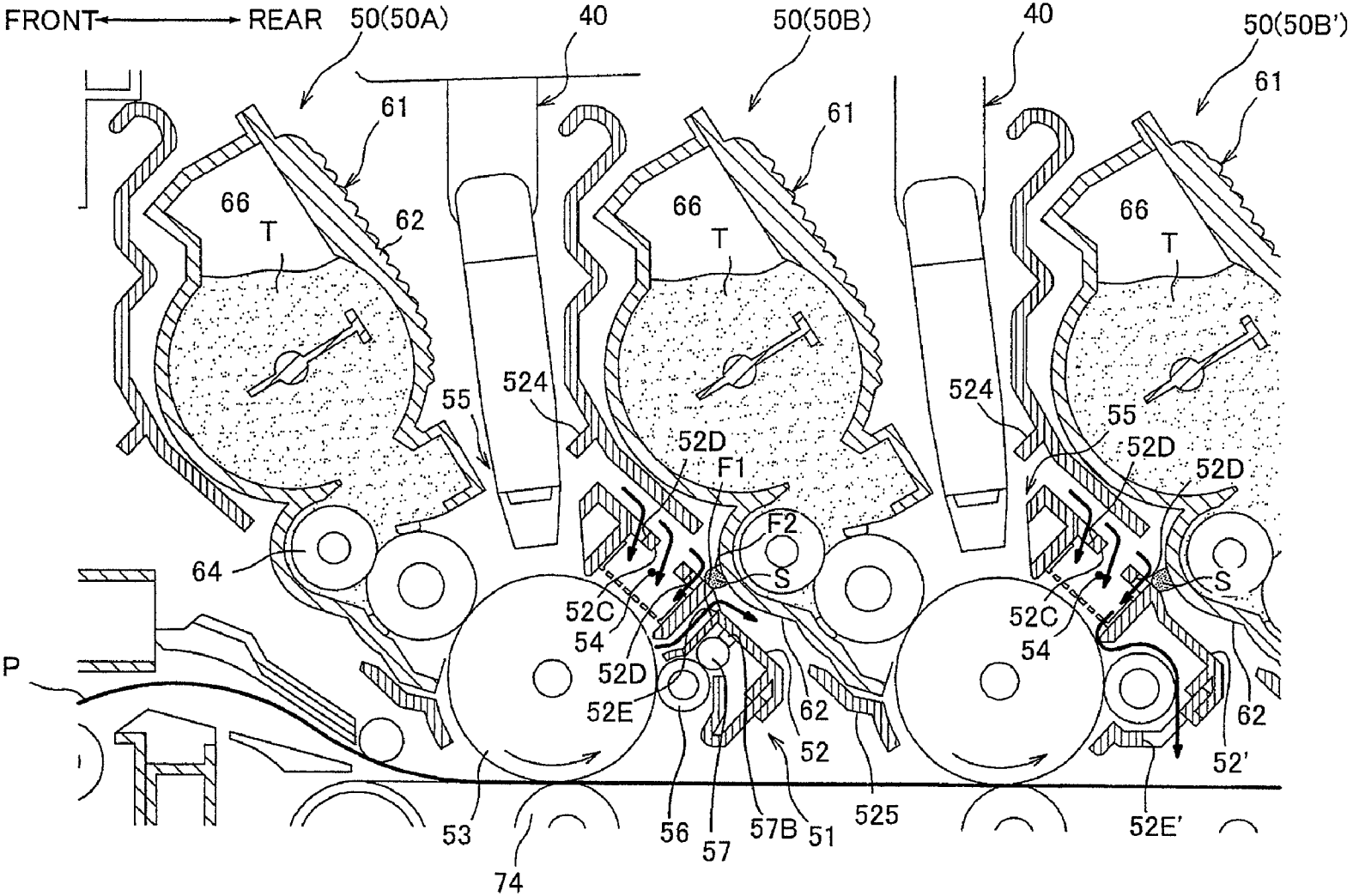
FIG. 8 is an enlarged cross-sectional view illustrating a flow of ion wind around a process cartridge detachably mounted in a color printer according to a third embodiment of the present invention.

Next, a third embodiment of the present invention will be described below referring to FIG. 8. The third embodiment is almost the same as the process cartridge 50 of the first embodiment.

In the third embodiment, the process cartridge 50B includes a sponge S instead of the film F of the first embodiment. The sponge S having elasticity is mounted on the developing frame 62 of the process cartridge 50B.

The drum frame 52 has an upper surface F1 positioned between the charging opening 52C of the most upstream side process cartridge 50A and the first opening 52E thereof. The developing frame 62 of the process cartridge 50B has a lower surface F2 positioned at a bottom portion of the process cartridge 50B and in confrontation with the upper surface F1. The sponge S is disposed at the lower surface F2 and a free end of the sponge S contacts the upper surface F1. With this configuration, since the film F need not be provided on the most upstream side process cartridge 50A, the production process of the most upstream side process cartridge 50A where the construction is different from that of the process cartridges 50B, 50B', 50B" can be reduced, and manufacturing cost can be saved.

In the process cartridge 50 according to the third embodiment, the drum frame 52, 52' includes a first support member 524 and a second support member 525.

The first support member 524 includes an end part which protrudes outwardly at a position higher than the free end of the sponge S. With this configuration, when the process cartridge 50 is detached from the main frame 10 and disposed on a board (not shown), the first support member 524 and the second support member 525 contacts the board and supports the process cartridge 50, thereby avoiding the deformation of the sponge S by the weight of the process cartridge 50.

Figure 9:
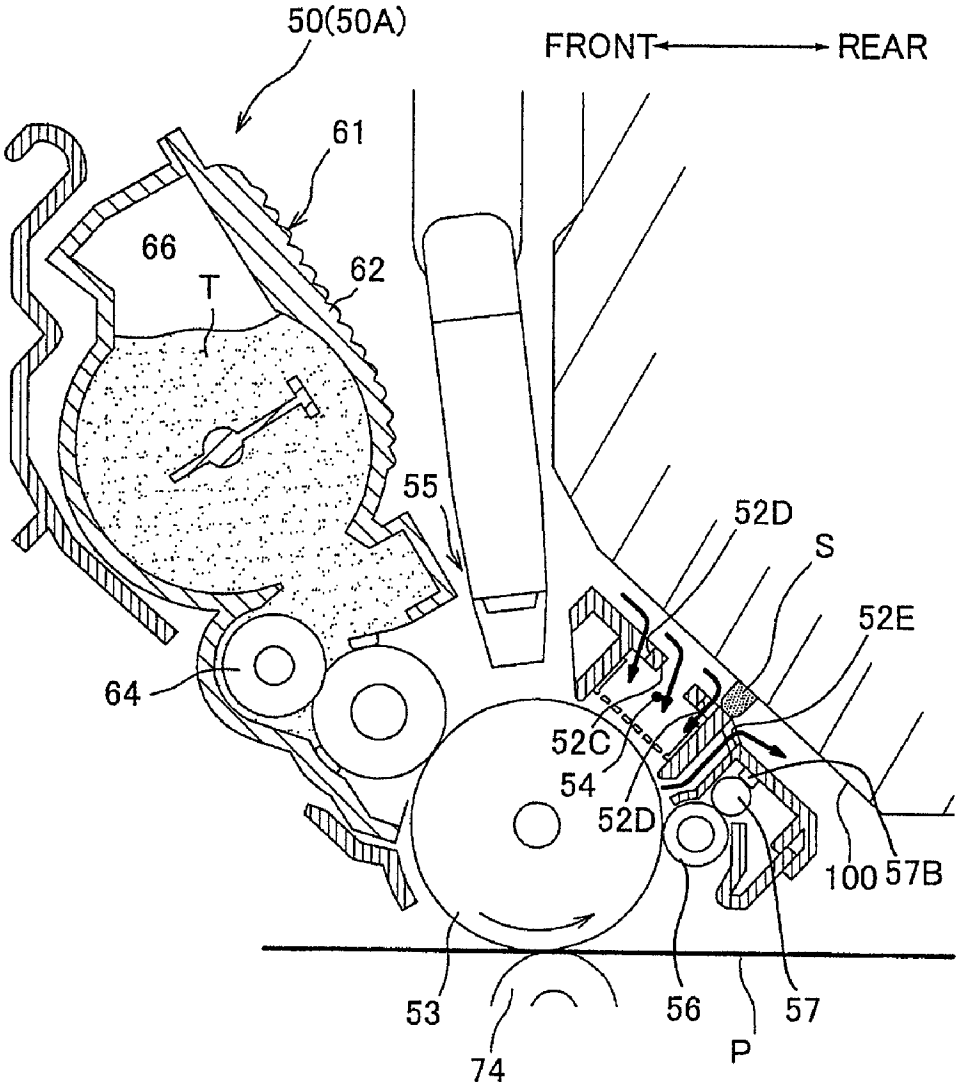
FIG. 9 is an enlarged cross-sectional view showing a process cartridge detachably mounted in a monochromatic printer according to a fourth embodiment of the present invention.

Next, a fourth embodiment of the present invention will be described below referring to FIG. 9. The fourth embodiment is almost the same as the process cartridge 50 of the first embodiment.

In the fourth embodiment, the image forming device 1 is a monochromatic printer having a single process cartridge 50A. The monochromatic image forming device 1 includes a main frame 100 provided with a sponge S as shown in FIG. 9. With this configuration, since the sponge S is provided not on the process cartridge 50 but on the main frame 100, erroneous removal of the sponge S from the main frame 100 can be avoided.

Figure 10:
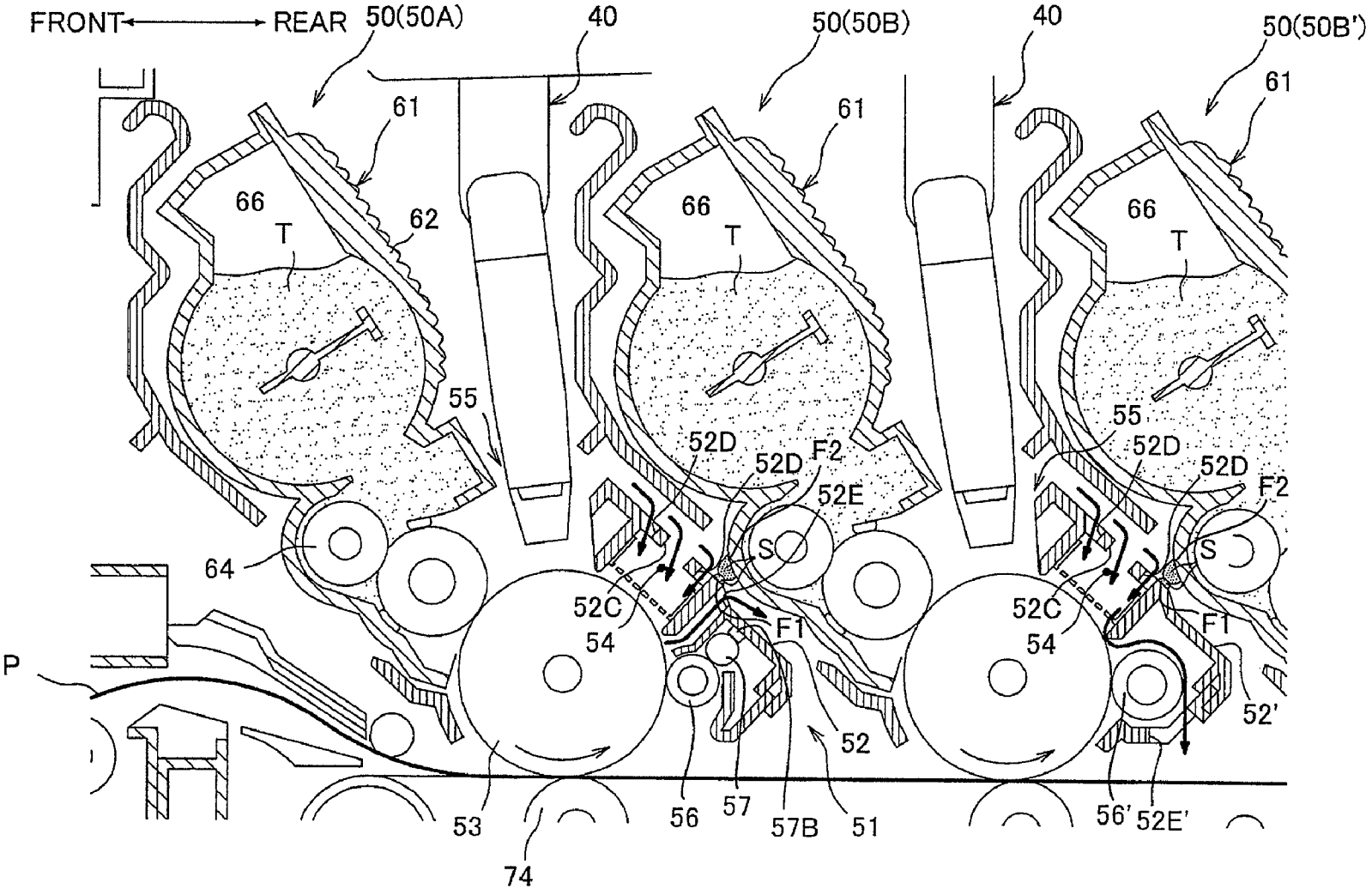
FIG. 10 is an enlarged cross-sectional view illustrating a flow of ion wind around a process cartridge according to a fifth embodiment of the present invention.

Next, a fifth embodiment of the present invention will be described below referring to FIG. 10. The fifth embodiment is almost the same as the process cartridge 50 of the first embodiment.

In the fifth embodiment, each of the upper surface F1 and the lower surface F2 is provided with a sponge S. Each of the sponges S has a free end that contacts each other. With this configuration, the air can be surely interrupted since the free end portions of the easily deformable sponges S are in contact with each other.

Figure 11:
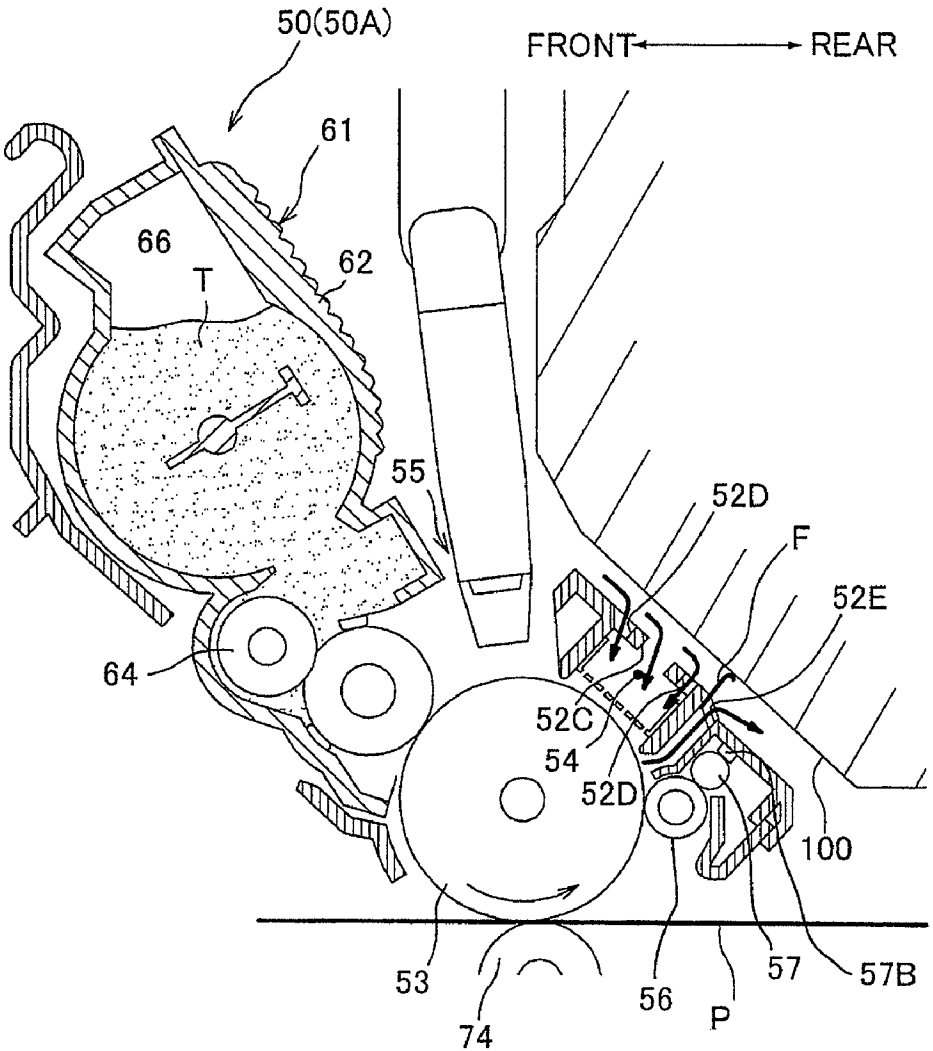
FIG. 11 is an enlarged cross-sectional view showing a process cartridge detachably mounted in a monochromatic printer according to a sixth embodiment of the present invention.

Next, a sixth embodiment of the present invention will be described below referring to FIG. 11. The sixth embodiment is almost the same as the process cartridge 50 of the first embodiment.

In the sixth embodiment, the image forming device 1 is a monochromatic printer having a single process cartridge 50A similarly to the fourth embodiment. The process cartridge 50 is provided with a film F having a top end which is in contact with a main frame 100 as shown in FIG. 11.

Figure 12:
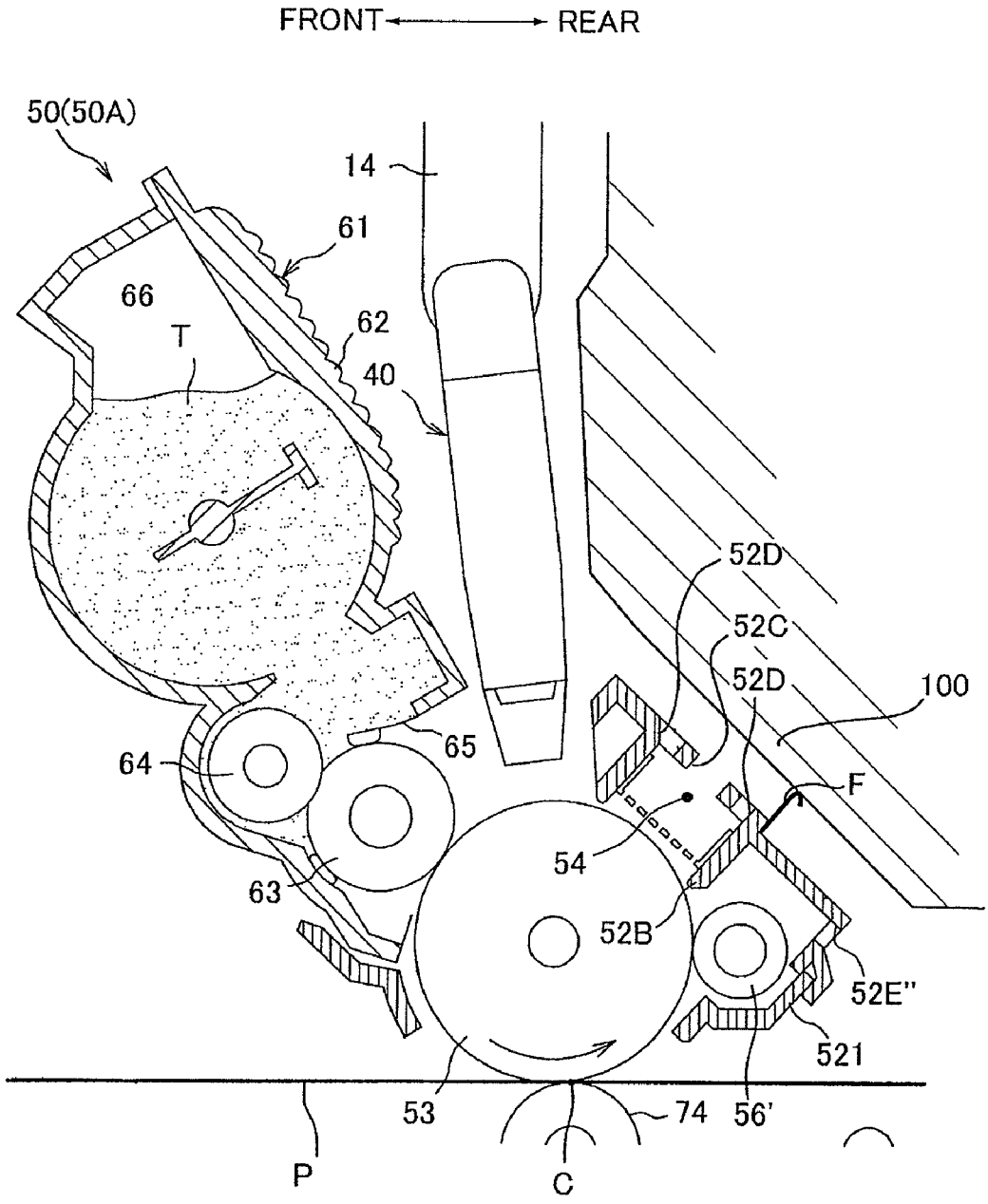
FIG. 12 is an enlarged cross-sectional view showing a process cartridge detachably mounted in a monochromatic printer according to a seventh embodiment of the present invention.

Next, a seventh embodiment of the present invention will be described below referring to FIG. 12. The seventh embodiment is almost the same as the process cartridge 50 of the second embodiment.

In the seventh embodiment, the image forming device 1 is a monochromatic printer having a single process cartridge 50A similarly to the sixth embodiment. The process cartridge 50 is provided with a film F having a top end which is in contact with a main frame 100 as shown in FIG. 12. The drum frame 52 is formed with a first opening 52E" similarly to the second embodiment.

While the invention has been described in detail with reference to specific embodiments thereof, if would be apparent to those skilled in the art that many modifications and variations may be made therein without departing from the spirit of the invention.

In the above-described embodiments, an interrupting member such as the film F and sponge S having elasticity or flexibility is provided on the process cartridge to interrupt an air flow between the process cartridge and the drum frame. However a rigid or non-deformable member is also available as the interrupting member such as a rib provided integrally with the drum frame or the developing frame. A minute clearance can be formed between the free end of interrupting member and the opposing process cartridge of the main frame.

In the above-described embodiments, the deformable interrupting member is configured to contact the neighboring developing frame. However, the interrupting member can be in contact with the neighboring drum frame.

In the above-described embodiments, the photosensitive drum 53 is employed as a photosensitive body. However, a belt shaped photosensitive member is also available.

Further, in the above-described embodiments, the charging wire 54 having a liner shape and the grid 58 are employed as a charger. However, a charger having a saw-edged shape can be employed instead of the charging wire 54.

Further, in the above-described embodiments, the scorotron type including the charging wire 54 and the grid 58 charging is employed. However, a corotron type charger eliminating the grid 58 is also available.

Further, in the above-described embodiments, rollers are used as the cleaning roller 56 and the collection roller 57. However, brushes are also available as the cleaning member and the collection member.

Further, in the above-described embodiments, the process cartridge 50 is disposed in an orientation that the end wall 521 faces obliquely downward and rearward, and the upper wall 522 faces obliquely upward and rearward. However, any posture of the process cartridge 50 is available.

Further, in the above-described embodiments, the LED array 40 having a plurality of LEDs arrayed in a single line in a right-to-left direction is employed as the exposure member that functions to expose the photosensitive body. However, a plurality of LED arrays each having a plurality of LEDs arrayed in a right-to-left direction can be arrayed in the front-to-rear direction. Further, another type of exposure unit is conceivable. The another type includes a plurality of blinking units each including a single light emitting element such as an LED and fluorescent lamp, and an optical shutter such as liquid crystal and PLTZ elements arrayed in the right-to-left direction at the position outside of the light emitting element. Furthermore, EL (electro luminescence) element and fluorescence unit are also available as the light source instead of LED.

What is claimed is:

1. An image forming device comprising:

a process cartridge comprising:

a photosensitive drum rotatable about an axis in a rotational direction and defining an image transfer position where a toner is transferred to an electrostatic latent image area formed on the photosensitive drum;

a charger disposed spaced away from the photosensitive drum for charging the photosensitive drum; and a frame formed with a first opening at a position opposite to the photosensitive drum with respect to the charger, the frame being also formed with a first vent hole for ventilation of a space defined by the frame, the first vent hole being positioned upstream of the first opening and downstream of the image transfer position of the photosensitive drum in the rotational direction of the photosensitive drum;

a wall section positioned in direct confrontation with the first opening; and a flow restrictor that restricts air flow and provided between the frame and the wall section and between the first opening and the first vent hole.

2. The image forming device as claimed in claim 1, wherein the flow restrictor is made from an elastic material.

3. The image forming device as claimed in claim 1, wherein the charger comprises a charging wire; and wherein the process cartridge further comprises a cleaner movably disposed to the first opening and slidable relative to the charging wire; and wherein the frame is further formed with a plurality of second vent holes positioned adjacent to the first opening to introduce an air outside of the frame into a portion inside of the frame and ambient to the charging wire.

4. The image forming device as claimed in claim 1, wherein the flow restrictor has a base end provided at one of the process cartridge and the wall section, and has a free end in contact with a remaining one of the process cartridge and the wall section.

5. The image forming device as claimed in claim 4, wherein the base end of the flow restrictor is fixed to the wall section.

6. The image forming device as claimed in claim 1, wherein the flow restrictor comprises a first flow restrictor provided at the process cartridge and a second flow restrictor provided at the wall section, the first flow restrictor and the second flow restrictor being in contact with each other.

7. The image forming device as claimed in claim 1, wherein the process cartridge further comprises:

a cleaning member disposed in contact with the photosensitive drum to remove a residual toner and foreign material on the photosensitive drum, the cleaning member being positioned upstream of the first opening and downstream of the transfer position in the rotational direction of the photosensitive drum;

a collection member disposed in contact with the cleaning member to absorb the toner and the foreign material on the cleaning member; and a partitioning wall that partitions a space surrounding the cleaning member and the collection member from a space surrounding the charger, the first vent hole being positioned between the first opening and the partitioning wall.

8. The image forming device as claimed in claim 1, wherein the process cartridge further comprises:

a cleaning member disposed inside the frame and in contact with the photosensitive drum to remove a residual toner and foreign material on the photosensitive drum, the cleaning member being positioned upstream of the first opening and downstream of the transfer position in the rotational direction of the photosensitive drum; and wherein the first vent hole is positioned opposite to the photosensitive drum with respect to the cleaning member, the frame having a portion between the first opening and the first vent hole, and wherein an air passage from the first opening to the first vent hole is defined by the portion of the frame and the cleaning member.

9. The image forming device as claimed in claim 8, wherein the first vent hole is positioned farther from the photosensitive drum than the cleaning member from the photosensitive drum and is exceeding over the charger as viewed from the photosensitive drum in an opposing direction between the photosensitive drum and the charger.

10. The image forming device as claimed in claim 1, wherein the frame is formed with a second opening, the second opening being positioned downstream of the first opening and upstream of the transfer position in the rotational direction of the photosensitive drum, and, the image forming device further comprising an exposure unit extending through the second opening to expose the photosensitive drum to a light.

11. The image forming device as claimed in claim 1, wherein the exposure unit comprises an LED array having a light emitting end in confrontation with the photosensitive drum and another end opposite to the light emitting end, and the image forming device further comprising a support frame supporting the another end of the LED array.

12. The image forming device as claimed in claim 1, wherein the process cartridge includes a first process cartridge and a second process cartridge neighboring to the first process cartridge, the second process cartridge functioning as the wall section with respect to the first process cartridge.

13. A process cartridge to be installed on an install portion of an image forming device, the install portion including a wall section, the process cartridge comprising:

a photosensitive drum rotatable about an axis in a rotational direction and defining an image transfer position where a toner is transferred to an electrostatic latent image area formed on the photosensitive drum;

a charger disposed spaced away from the photosensitive drum for charging the photosensitive drum; and a frame formed with a first opening at a position opposite to the photosensitive drum with respect to the charger, the first opening being in direct confrontation with the wall section upon installation of the frame into the install portion, the frame being also formed with a first vent hole for ventilation of a space defined by the frame, the first vent hole being positioned upstream of the first opening and downstream of the image transfer position of the photosensitive drum in the rotational direction of the photosensitive drum; and a flow restrictor that restricts air flow and provided between the frame and the wall section and between the first opening and the first vent hole.

14. The process cartridge as claimed in claim 13, wherein the flow restrictor is made from an elastic material.

15. The process cartridge as claimed in claim 13, wherein the frame is further formed with a plurality of second vent holes positioned adjacent to the first opening to introduce an air outside of the frame into a portion inside of the frame and ambient to the charger.

16. The process cartridge as claimed in claim 13, wherein the flow restrictor is in contact with the wall section upon installation of the frame into the install portion.

17. The process cartridge as claimed in claim 13, further comprising:

a cleaning member disposed in contact with the photosensitive drum to remove a residual toner and foreign material on the photosensitive drum, the cleaning member being positioned upstream of the first opening and downstream of the transfer position in the rotational direction of the photosensitive drum;

a collection member disposed in contact with the cleaning member to absorb the toner and the foreign material on the cleaning member; and a partitioning wall that partitions a space surrounding the cleaning member and the collection member from a space surrounding the charger, the first vent hole being positioned between the first opening and the partitioning wall.

18. The process cartridge as claimed in claim 13, further comprising:

a cleaning member disposed inside the frame and in contact with the photosensitive drum to remove a residual toner and foreign material on the photosensitive drum, the cleaning member being positioned upstream of the first opening and downstream of the transfer position in the rotational direction of the photosensitive drum; and wherein the first vent hole is positioned opposite to the photosensitive drum with respect to the cleaning member, the frame having a portion between the first opening and the first vent hole, and wherein an air passage from the first opening to the first vent hole is defined by the portion of the frame and the cleaning member.

19. The process cartridge as claimed in claim 18, wherein the first vent hole is positioned farther from the photosensitive drum than the cleaning member from the photosensitive drum and is exceeding over the charger as viewed from the photosensitive drum in an opposing direction between the photosensitive drum and the charger.

20. A process cartridge to be installed on an install portion of an image forming device in a juxtaposed fashion so that mutually neighboring process cartridges are positioned side by side, the process cartridge comprising:

a photosensitive drum rotatable about an axis in a rotational direction and defining an image transfer position where a toner is transferred to an electrostatic latent image area formed on the photosensitive drum;

a charger disposed spaced away from the photosensitive drum for charging the photosensitive drum; and a frame foamed with a first opening at a position opposite to the photosensitive drum with respect to the charger, the first opening being in direct confrontation with a neighboring process cartridge upon installation of the frame into the install portion, the frame being also formed with a first vent hole for ventilation of a space defined by the frame, the first vent hole being positioned upstream of the first opening and downstream of the image transfer position of the photosensitive drum in the rotational direction of the photosensitive drum; and a flow restrictor that restricts air flow flowing between the frame and the neighboring process cartridge, the flow restrictor being positioned between the first opening and the first vent hole.

21. The process cartridge as claimed in claim 20, wherein the flow restrictor is made from an elastic material.

22. The process cartridge as claimed in claim 20, wherein the frame is further formed with a plurality of second vent holes positioned adjacent to the first opening to introduce an air outside of the frame into a portion inside of the frame and ambient to the charger.

23. The process cartridge as claimed in claim 20, wherein the flow restrictor is in contact with the neighboring process cartridge upon installation of the frame into the install portion.

24. The process cartridge as claimed in claim 20, further comprising:

a cleaning member disposed in contact with the photosensitive drum to remove a residual toner and foreign material on the photosensitive drum, the cleaning member being positioned upstream of the first opening and downstream of the transfer position in the rotational direction of the photosensitive drum;

a collection member disposed in contact with the cleaning member to absorb the toner and the foreign material on the cleaning member; and a partitioning wall that partitions a space surrounding the cleaning member and the collection member from a space surrounding the charger, the first vent hole being positioned between the first opening and the partitioning wall.

25. The process cartridge as claimed in claim 20, further comprising:

a cleaning member disposed inside the frame and in contact with the photosensitive drum to remove a residual toner and foreign material on the photosensitive drum, the cleaning member being positioned upstream of the first opening and downstream of the transfer position in the rotational direction of the photosensitive drum; and wherein the first vent hole is positioned opposite to the photosensitive drum with respect to the cleaning member, the frame having a portion between the first opening and the first vent hole, and wherein an air passage from the first opening to the first vent hole is defined by the portion of the frame and the cleaning member.

26. The process cartridge as claimed in claim 25, wherein the first vent hole is positioned farther from the photosensitive drum than the cleaning member from the photosensitive drum and is exceeding over the charger as viewed from the photosensitive drum in an opposing direction between the photosensitive drum and the charger.

* * * * *